US008656746B2

(12) United States Patent
Buhl

(10) Patent No.: US 8,656,746 B2
(45) Date of Patent: Feb. 25, 2014

(54) LOCK CYLINDER

(75) Inventor: Joachim Buhl, Salzburg (DE)

(73) Assignee: ABUS August Bremicker Sohne KG (DE)

( * ) Notice: Subject to any disclaimer, the term of this patent is extended or adjusted under 35 U.S.C. 154(b) by 0 days.

(21) Appl. No.: 13/427,592

(22) Filed: Mar. 22, 2012

(65) Prior Publication Data

US 2013/0067972 A1 Mar. 21, 2013

(30) Foreign Application Priority Data

Mar. 29, 2011 (DE) ..... 10 2011 015 314

(51) Int. Cl.
*E05B 27/00* (2006.01)

(52) U.S. Cl.
USPC ..... 70/366; 70/419; 70/377; 70/409

(58) Field of Classification Search
USPC ..... 70/365, 366, 407, 409, 377, 419
See application file for complete search history.

(56) References Cited

U.S. PATENT DOCUMENTS

| | | | | | |
|---|---|---|---|---|---|
| 3,797,290 | A | * | 3/1974 | Taylor | 70/366 |
| 3,821,886 | A | * | 7/1974 | Ladewig | 70/366 |
| 3,972,210 | A | * | 8/1976 | Toivonen et al. | 70/366 |
| 4,062,211 | A | * | 12/1977 | Miller et al. | 70/366 |
| 4,109,495 | A | * | 8/1978 | Roberts | 70/365 |
| 4,180,999 | A | * | 1/1980 | Hurskainen et al. | 70/366 |
| 4,317,347 | A | * | 3/1982 | Martikainen et al. | 70/366 |
| 4,320,640 | A | * | 3/1982 | Martikainen | 70/366 |
| 4,336,700 | A | * | 6/1982 | Baltscheffsky et al. | 70/366 |
| 4,351,172 | A | * | 9/1982 | Martikainen | 70/366 |
| 4,370,875 | A | * | 2/1983 | Piiroinen | 70/422 |
| 4,407,147 | A | | 10/1983 | Larson | |
| 4,651,546 | A | * | 3/1987 | Evans | 70/366 |
| 5,205,143 | A | * | 4/1993 | Hakkarainen et al. | 70/366 |
| 5,388,438 | A | * | 2/1995 | Paavo | 70/366 |
| 5,490,405 | A | * | 2/1996 | Ramo et al. | 70/366 |
| 5,613,389 | A | * | 3/1997 | Hauser | 70/366 |

(Continued)

FOREIGN PATENT DOCUMENTS

| | | | |
|---|---|---|---|
| DE | 2905946 | A1 | 8/1979 |
| EP | 0488619 | A1 | 6/1992 |
| EP | 0712979 | A1 | 5/1996 |
| EP | 1826340 | A1 | 8/2007 |

OTHER PUBLICATIONS

German Search Report, relating to German Patent Application No. 10 2011 015 314.4, mailed Jul. 19, 2011.

*Primary Examiner* — Suzanne Barrett
(74) *Attorney, Agent, or Firm* — Amster, Rothstein & Ebenstein LLP

(57) ABSTRACT

A lock cylinder including a cylinder core rotatably supported about a cylinder axis in a cylinder housing; locking pin which blocks the cylinder core against a rotational movement in a radially outer blocking position and which releases the cylinder core for a rotational movement in a radially inner release position; tumbler disks rotatably supported between a latch position and an unlatch position, wherein each tumbler disk has a central reception opening for receiving a key and at least one peripheral cut-out for receiving the locking pin in the release position, wherein the locking pin can only be displaced into the release position when all the tumbler disks are in their unlatch position; and intermediate disks arranged along a cylinder axis in the cylinder core. A respective intermediate disk is arranged between two mutually adjacent tumbler disks, the intermediate disks having a predefined rotational play relative to the cylinder core.

9 Claims, 3 Drawing Sheets

(56) References Cited

U.S. PATENT DOCUMENTS 6,003,351 A * 12/1999 Chao et al. ..... 70/366
6,155,089 A * 12/2000 Hurskainen et al. ..... 70/278.3
6,553,801 B2 * 4/2003 Chen ..... 70/366
6,776,017 B2 * 8/2004 Herdman ..... 70/338
6,799,447 B2 * 10/2004 Mielonen et al. ..... 70/366
7,703,311 B2 * 4/2010 Agbay ..... 70/366

* cited by examiner

LOCK CYLINDER

The present invention relates to a lock cylinder in accordance with the preamble of claim 1.

Such a lock cylinder, which is also called a disk cylinder, is disclosed in EP 0 712 979 B1, for example.

Figure 1:
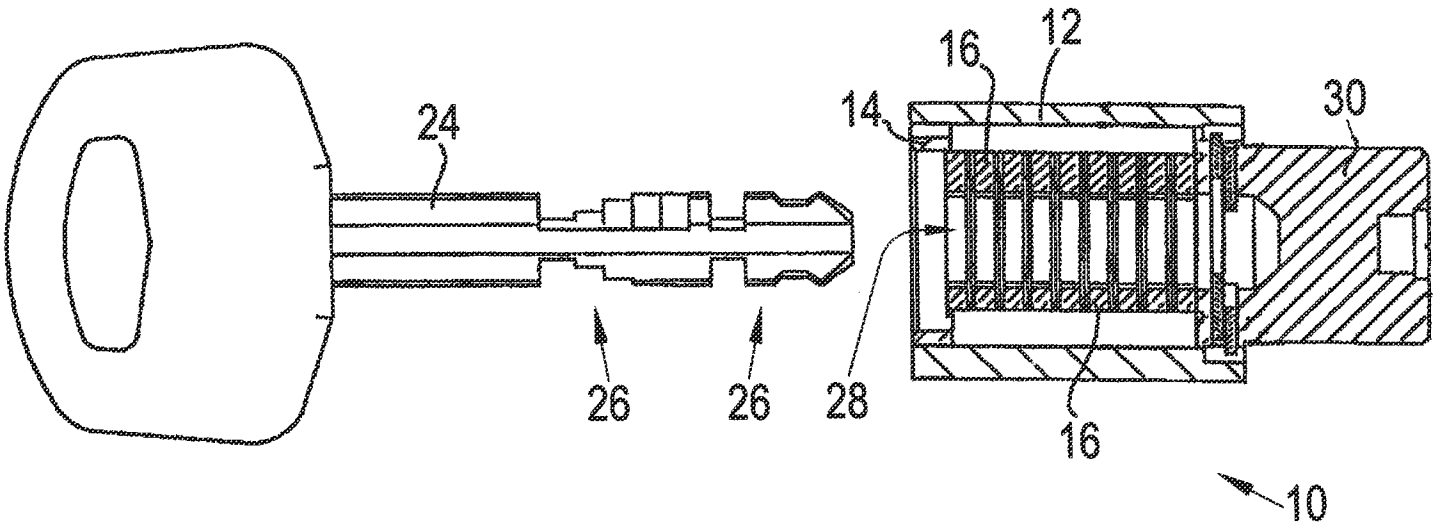
CONVENTIONAL ART Fig.1
Figure 2:
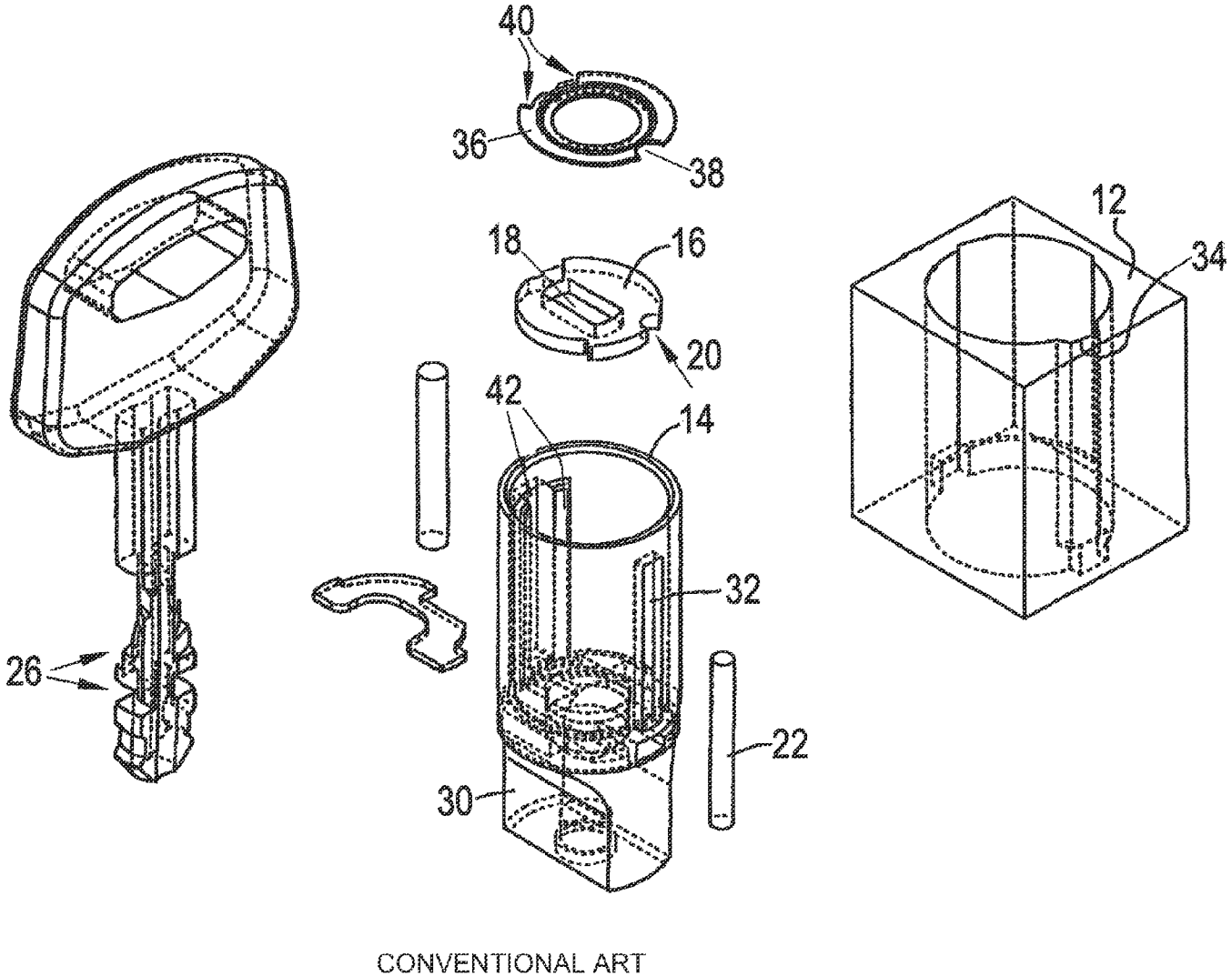

In accordance with FIGS. 1 and 2, a disk cylinder or lock cylinder 10 of this kind has a cylinder housing 12 and a cylinder core 14 supported rotatably about a cylinder axis in the cylinder housing 12. The rotational movement of the cylinder core 14 can be transmitted via a coupling section 30 connected to the cylinder core 14 to a latching mechanism of a lock which is not shown.

A plurality of rotatable tumbler disks 16 are received behind one another along the cylinder axis in the cylinder core 14. The tumbler disks 16 have respective central reception openings 18 which together form a keyway 28 for introducing a key 24 and which have a rectangular cross-section in the embodiment shown. The tumbler disks 16 furthermore have respective peripheral cut-outs 20 for receiving a common locking pin 22 which is aligned parallel to the cylinder axis.

The locking pin 22 is radially movably received in a slit 32 provided in the wall of the cylinder core 14. When the lock cylinder 10 is in its closed position and the tumbler disks 16 are thus rotated into their latch position, the locking pin adopts a radially outer blocking position. In this blocking position, a part section of the locking pin 22 engages into a locking pin receiver 34 provided at the inner wall of the cylinder housing 12 so that the cylinder core 14 is blocked against a rotational movement relative to the cylinder housing 12.

The tumbler disks 16 can be moved from their latch position into an unlatch position by means of the key 24. When all the tumbler disks 16 are located in their unlatch position, i.e. when the peripheral cut-outs 20 of all the tumbler disks 16 are aligned toward one another and radially to the locking pin 22, the locking pin 22 can be displaced radially inwardly into its release position in which it is located outside the locking pin receiver 34. The cylinder core 14 is thereby released for a rotational movement relative to the cylinder housing 12.

The key 24 associated with the lock cylinder 10 has a plurality of differently angled notches 26 which correspond to different angular positions of the peripheral cut-outs 20 of the tumbler disks 22. After the introduction into the keyway 28, the key 24 is rotated in the opening direction, starting from a zero position in which the central reception openings 18 are aligned with one another.

The tumbler disks 16 have a specific rotational clearance with respect to the respective associated notch 26 of the key 24. The dimension of this rotational clearance depends on the angular dimension of the respective notch 26. I.e. in dependence on the angular dimension of the notches 26, control sections of the respective notches 26 and corresponding control sections of the central reception openings 18 of the associated respective tumbler disks 16 come into engagement with one another at different points in time or at different angular positions.

For example, starting from the zero position of the tumbler disks 16, the total rotational path of the key up to the reaching of the unlatch position of all tumbler disks 16 amounts to approximately 110°, i.e. after a rotation of the key 24 by approximately 110°, all the tumbler disks 16 are sorted and are oriented in radial alignment with the locking pin 22. A pattern of six different angular positions is typically provided at uniform intervals for the possible angular positions of the peripheral cut-outs 20, with the angular spacing between two adjacent peripheral cut-outs 20 amounting to approximately 18°. Correspondingly, there are six possible codings for each tumbler disk 16, with the tumbler disk 16 being rotated by a specific angle out of its zero position for setting one of these codings. In the exemplary lock cylinder 10, a coding "1" is reached after a rotation of the key 24 by approximately 20°; an adjacent coding "2" after a rotation of approximately 38°, etc.; and finally a coding "6" after a rotation of approximately 110°, respectively measured from the zero position. The peripheral cut-outs 20 are accordingly arranged at an angular spacing from the zero position, said angular spacing corresponding to the respective coding.

At the coding "6", a compulsory coupling between the corresponding tumbler disk 16 and the associated section of the key 24 can be provided, i.e. no notch or a notch having the angular dimension 0° is present so that no rotational clearance is present between the key 24 and the tumbler disk 16.

At the coding "1", in contrast, there is the largest possible rotational clearance between the key 24 and the tumbler disk 16, i.e. a notch having an angular dimension of approximately 90° is provided at the key 24. A tumbler disk 16 of the coding "1" is thus generally only taken along (i.e. rotated) at the end of the rotational actuation of the key 24, i.e. after a rotation by approximately 90°, and is brought into its unlatch position by a rotation of the key by a further approximately 20°.

Typically, a lock cylinder of this kind also has one or more so-called lift disks which generally are tumbler disks having the coding "6", such a disk being provided in a predefined axial position, e.g. right at the front, right at the back or at the middle of the lock cylinder 10 with respect to the key introduction direction. The tumbler disk acting as a lift disk has a compulsory coupling with the key. Starting from the release position of the locking pin 22, the lift disk ensures that, on a key actuation in the closing direction, the locking pin 22 is lifted properly from the peripheral cut-outs 20 of the tumbler disk 16 and does not catch, for instance.

It is furthermore customary to arrange intermediate disks 36 between the tumbler disks 16, said intermediate disks being rotationally fixedly coupled to the cylinder core 14. The intermediate disks 36 decouple adjacent tumbler disks 16 from one another so that the rotational movement of a respective tumbler disk 16 does not effect a co-rotation of the tumbler disk 16 adjacent thereto due to friction. Such a taking along by friction locking could namely have the result that a tumbler disk 16 is under certain circumstances rotated beyond its unlatch position and the lock cylinder 10 can thus no longer be opened.

The rotationally fixed coupling of the intermediate disks 36 with the cylinder core can take place by abutment sections 40 of the intermediate disks 36 which extend at least partly in the radial direction (FIG. 2) and which contact without clearance corresponding projections 42 formed at the inner wall of the cylinder core 14.

Each intermediate disk 36 has a peripheral cutaway 38 which radially aligns with the locking pin 22. The dimensions of the peripheral cutaway 38 are adapted to the diameter of the locking pin 22 so that the intermediate disks 36 do not impede a displacement of the locking pin 22 into its release position.

Lock cylinders of the above-described kind have proved to be advantageously secure against manipulation. Nevertheless, an unauthorized person can attempt with the aid of a suitable so-called picking tool to feel the individual tumbler disks after one another and to thereby sort them after one another, i.e. to bring them into the respective unlatch position.

It is therefore the object of the invention to provide a lock cylinder of the above-explained kind which has an improved security against manipulation.

The object is satisfied by a lock cylinder according to claim 1 and in particular in that the intermediate disks have a predefined rotational clearance relative to the cylinder core.

A complete decoupling of adjacent tumbler disks relative to one another is hereby deliberately not effected. Instead, the rotation of a tumbler disk, for example by means of a picking tool, has the result that a tumbler disk which is adjacent hereto and which may have already been brought into its unlatch position by means of the picking tool is also again set into rotation by friction locking (i.e. frictional coupling) and is thus again displaced from its unlatch position under certain circumstances.

It is understood that the tumbler disks in accordance with the invention may not only be arranged between two mutually adjacent tumbler disks, but also right at the start or right at the end of the stack formed from the tumbler disks and the intermediate disks, that is adjacent to an end face of the cylinder core.

In accordance with a preferred embodiment of the invention a predefined number of possible different codings is provided for the tumbler disks, with each of the codings being defined by a specific angular position of the peripheral cut-out of the tumbler disk with respect to the central reception opening and the different codings preferably being provided at equal angular intervals. In this embodiment the rotational clearance of the intermediate disks corresponds to the minimal angular spacing between the latch position (i.e. the explained zero position) and the unlatch position of the tumbler disks for the different possible codings. Such a limited rotational clearance effectively prevents a feeling of the lock by means of a picking tool without the risk arising in so doing that, on a proper actuation of the lock cylinder by means of the associated key, individual tumbler disks are carried along beyond their unlatch position due to friction locking. In order to achieve a coupling between two adjacent tumbler disks by friction locking which is as effective as possible with respect to security against picking, the rotational clearance is selected as large as possible and thus corresponds to at least the named minimal angular spacing between the latch position and the unlatch position of the tumbler disks. However, in order also not to move the tumbler disks beyond their unlatch position unintentionally, the rotational clearance is preferably also in turn not larger than the named minimal angular spacing.

Each intermediate disk preferably has two abutment sections along its periphery which cooperate with two corresponding abutment sections at the inner periphery of the cylinder core for limiting the rotational clearance of the intermediate disk. The spacing of the abutment sections from one another is enlarged with respect to the above-explained conventional intermediate disk whose abutment sections ensure a rotationally fixed support in the cylinder core. As such, for modifying a conventional lock cylinder in accordance with the invention, an expensive modification of the cylinder core, in particular a displacement of the projections provided at the inner wall of the cylinder core, is not necessary. This makes it possible to retrofit a conventional lock cylinder having rotationally fixed intermediate disks in a simple manner with the intermediate disks in accordance with the invention having rotational clearance.

Each intermediate disk preferably has a peripheral cutaway adapted to receive the locking pin in its release position independently of the angular position of the intermediate disk. This is in particular useful when the diameter of the intermediate disks is substantially the same as the diameter of the tumbler disks in order nevertheless to ensure a displacement of the locking pin into its release position independently of the angular position of the intermediate disks.

In accordance with an advantageous embodiment, the angular dimension of the peripheral cutaway of the respective intermediate disks corresponds at least to the sum of the angular dimension of the peripheral cutouts of the tumbler disks and the rotational clearance of the respective intermediate disk.

Provision is made in accordance with a further preferred embodiment of the invention that the key has a plurality of differently angled notches associated with a respective tumbler disk, with the dimension of the angling of a respective notch corresponding to the coding of the associated tumbler disk. On a rotation of the key into an open position each notch cooperates with a corresponding control section of the central reception opening of the associated tumbler disk such that each tumbler disk is rotated into its unlatch position.

Each intermediate disk is preferably coupled with the adjacent tumbler disks by friction locking. This can be achieved in that the tumbler disks and the intermediate disks are pretensioned toward one another in the axial direction, for example by means of a spring.

Provision is made in accordance with a further preferred embodiment that at least one tumbler disk formed as a lift disk has a substantially clearance-free compulsory coupling of its control section with the corresponding notch of the key and that the peripheral cut-out of the lift disk has at least one run-on chamfer which cooperates with the locking pin such that, on a rotation of the lift disk from its unlatch position into the latch position, the locking pin is displaced from its release position into its blocking position. The lift disk can be in any desired position with respect to the cylinder axis.

Further advantageous embodiments of the invention are set forth in the dependent claims, in the description and in the drawings.

Figure 3:
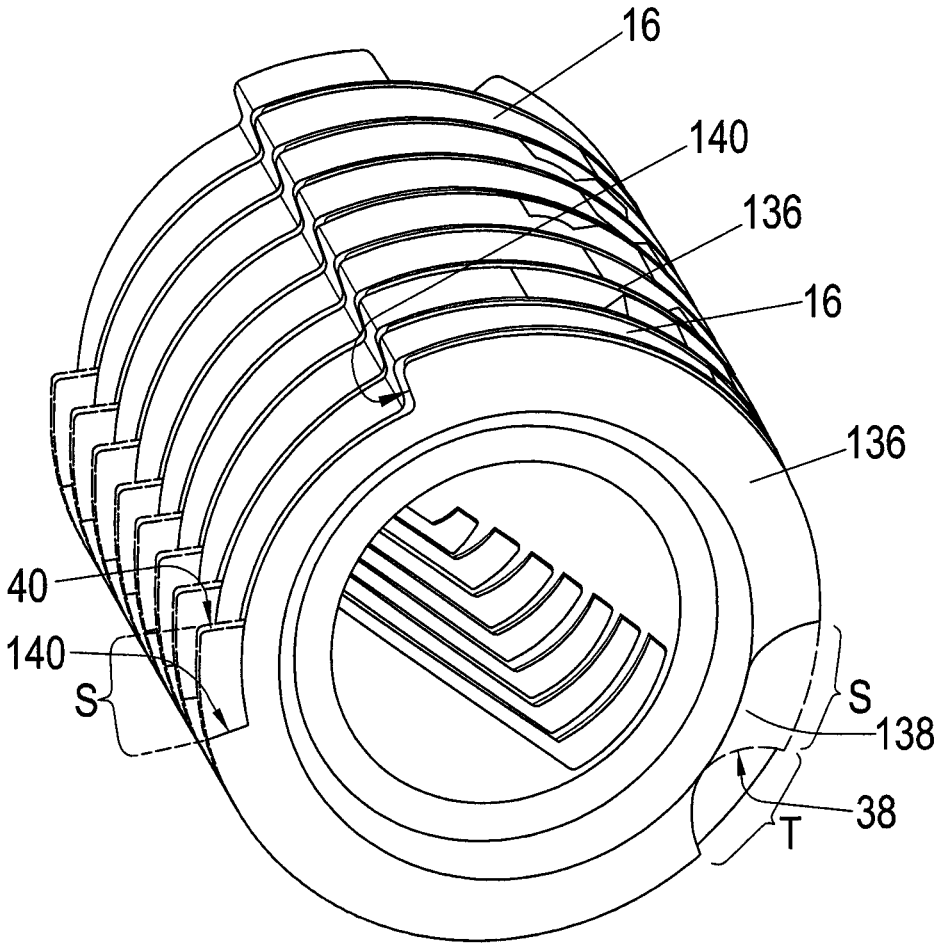

The invention will be described in the following with reference to an embodiment and to the drawings. There are shown:

FIG. 1 a longitudinal section through a conventional lock cylinder;

FIG. 2 an exploded view of the conventional lock cylinder of FIG. 1; and FIG. 3 a perspective view of a stack of tumbler disks and intermediate disks for a lock cylinder in accordance with the invention.

A lock cylinder in accordance with the invention largely corresponds to the lock cylinder 10 in accordance with FIGS. 1 and 2 which was already described above in detail.

The main difference between a conventional lock cylinder as is shown by FIGS. 1 and 2 and the lock cylinder in accordance with the invention can be found in the design of the intermediate disks.

In accordance with FIG. 2 the spacing of the abutment sections 40 is selected for a conventional intermediate disk 36 such that both abutment sections 40 contact the projections 42 of the cylinder core 14 simultaneously and thus a rotationally fixed coupling of the intermediate disks 36 with the cylinder core 14 is ensured. With an intermediate disk 136 in accordance with the invention as shown in FIG. 3, in contrast, the mutual spacing of the abutment sections 140 is enlarged by a specific angular dimension. For comparison, in FIG. 3 the corresponding abutment section 40 of a conventional intermediate disk is shown by dashed lines. The named angular dimension defines a rotational clearance S of the respective intermediate disk 136.

This rotational clearance S is preferably selected such that, on the rotation of a tumbler disk 16 in the direction of its unlatch position, an adjacent tumbler disk 16 is only taken along via the associated intermediate disk 136 due to friction locking so far as it corresponds to a rotation of the tumbler disk 16 from its zero position into an angular position having the coding "1". The rotational clearance S of the intermediate disks 136 should accordingly amount to approximately 20° for a use with the above-described lock cylinder 10, corresponding to the angular spacing between the zero position and the angular position of the coding "1". It is understood that this specific angular value for the rotational clearance S relates to the above-described lock cylinder 10 with its specific associated angular dimensions. The intermediate disks 136 can naturally also have a different value of the rotational clearance S for other angular dimensions and coding patterns.

Due to the limitedly rotatable intermediate disks 136, a coupling is established between adjacent tumbler disks 16 which makes a manipulation of the lock cylinder 10 by feeling substantially more difficult, but nevertheless effectively prevents a rotation of individual tumbler disks 16 beyond their respective unlatch positions.

To ensure that the locking pin 22 can be displaced without hindrance into its release position despite the rotational clearance S, the angular dimension of the respective peripheral cutaways 138 of the intermediate disks 136 according to FIG. 3 is likewise enlarged in comparison with the angular dimension of the peripheral cutaways 38 of the conventional intermediate disks 36 in accordance with FIG. 2. For comparison, in FIG. 3 the peripheral cutaway 38 of a conventional intermediate disk is shown by dashed lines. The named angular dimension of the peripheral cutaways 138 preferably corresponds to the sum of the angular dimension T of the peripheral cut-outs 20 of the tumbler disks 16 and the rotational clearance S of the intermediate disks 136.

REFERENCE NUMERAL LIST

10 lock cylinder
12 cylinder housing
14 cylinder core
16 tumbler disk
18 central reception opening
20 peripheral cut-out
22 locking pin
24 key
26 notch
28 keyway
30 coupling section
32 slit
34 locking pin receiver
36, 136 intermediate disk
38, 138 peripheral cutaway
40, 140 abutment section
S rotational clearance
T angular dimension of the peripheral cut-outs 20

The invention claimed is:

1. A lock cylinder comprising a cylinder housing (12);

a cylinder core (14) rotatably supported about a cylinder axis in the cylinder housing (12);

at least one locking pin (22) which is provided at the outer periphery of the cylinder core (14), which is aligned parallel to the cylinder axis, which can be displaced radially to the cylinder axis, which blocks the cylinder core (14) against a rotational movement in a radially outer blocking position and which releases the cylinder core (14) for a rotational movement in a radially inner release position; a plurality of tumbler disks (16) arranged along the cylinder axis in the cylinder core (14) and rotatably supported between a latch position and an unlatch position, wherein each tumbler disk (16) has a central reception opening (18) for receiving a key (24) and at least one peripheral cut-out (20) for receiving the locking pin (22) in the release position, wherein the locking pin (22) can only be displaced into the release position when all the tumbler disks (16) are in their unlatch position in which the peripheral cut-out (20) of the respective tumbler disk (16) is aligned radially to the locking pin (22); and a plurality of intermediate disks (136) arranged along the cylinder axis in the cylinder core, wherein a respective intermediate disk (136) is arranged between two mutually adjacent tumbler disks (16), and wherein the intermediate disks (136) have a predefined rotational clearance (S) relative to the cylinder core (14) while the locking pin (22) is in the radially outer blocking position.

2. A lock cylinder in accordance with claim 1, wherein a predefined number of possible different codings is provided for the tumbler disks (16), with each of the codings being defined by a specific angular position of the peripheral cut-out (20) of the tumbler disk (16) with respect to the central reception opening (18), with the rotational clearance (S) of the intermediate disks (136) corresponding to the smallest angular spacing between the latch position and the unlatch position of the tumbler disks (16) with respect to the different possible codings.

3. A lock cylinder in accordance with claim 1, wherein each intermediate disk (136) has two abutment sections (140) along its periphery which cooperate with two corresponding abutment sections (42) at the inner periphery of the cylinder core (14) for limiting the rotational clearance (S) of the intermediate disk.

4. A lock cylinder in accordance with claim 1, wherein each intermediate disk (136) has a peripheral cutaway (138) adapted to receive the locking pin (22) in its release position independently of the angular position of the intermediate disk (136).

5. A lock cylinder in accordance with claim 4, wherein the angular dimension of the peripheral cutaway (138) of the respective intermediate disks (136) corresponds to at least the sum of the angular dimension (T) of the peripheral cut-outs (20) of the tumbler disks (16) and the rotational clearance (S) of the respective intermediate disk (136).

6. A lock cylinder in accordance with claim 1, wherein the key (24) has a plurality of differently angled notches (26) associated with a respective tumbler disk (16), with the dimension of the angling of a respective notch (26) corresponding to the coding of the associated tumbler disk (16), wherein each notch (26), on a rotation of the key (24) into an open position, cooperates with a corresponding control section of the central reception opening (18) of the associated tumbler disk (16) such that each tumbler disk (16) is rotated into its unlatch position.

7. A lock cylinder in accordance with claim 1, wherein each intermediate disk (136) is coupled with the adjacent tumbler disks (16) by friction locking.

8. A lock cylinder comprising a cylinder housing (12);

a cylinder core (14) rotatably supported about a cylinder axis in the cylinder housing (12);

at least one locking pin (22) which is provided at the outer periphery of the cylinder core (14), which is aligned parallel to the cylinder axis, which can be displaced radially to the cylinder axis, which blocks the cylinder core (14) against a rotational movement in a radially outer blocking position and which releases the cylinder core (14) for a rotational movement in a radially inner release position; a plurality of tumbler disks (16)

arranged along the cylinder axis in the cylinder core (14) and rotatably supported between a latch position and an unlatch position, wherein each tumbler disk (16) has a central reception opening (18) for receiving a key (24) and at least one peripheral cut-out (20) for receiving the locking pin (22) in the release position, wherein the locking pin (22) can only be displaced into the release position when all the tumbler disks (16) are in their unlatch position in which the peripheral cut-out (20) of the respective tumbler disk (16) is aligned radially to the locking pin (22); and a plurality of intermediate disks (136) arranged along the cylinder axis in the cylinder core, wherein a respective intermediate disk (136) is arranged between two mutually adjacent tumbler disks (16), wherein the intermediate disks (136) have a predefined rotational clearance (S) relative to the cylinder core (14), and wherein a predefined number of possible different codings is provided for the tumbler disks (16), with each of the codings being defined by a specific angular position of the peripheral cut-out (20) of the tumbler disk (16) with respect to the central reception opening (18), with the rotational clearance (S) of the intermediate disks (136) corresponding to the smallest angular spacing between the latch position and the unlatch position of the tumbler disks (16) with respect to the different possible codings.

9. A lock cylinder comprising a cylinder housing (12);

a cylinder core (14) rotatably supported about a cylinder axis in the cylinder housing (12);

at least one locking pin (22) which is provided at the outer periphery of the cylinder core (14), which is aligned parallel to the cylinder axis, which can be displaced radially to the cylinder axis, which blocks the cylinder core (14) against a rotational movement in a radially outer blocking position and which releases the cylinder core (14) for a rotational movement in a radially inner release position; a plurality of tumbler disks (16) arranged along the cylinder axis in the cylinder core (14) and rotatably supported between a latch position and an unlatch position, wherein each tumbler disk (16) has a central reception opening (18) for receiving a key (24) and at least one peripheral cut-out (20) for receiving the locking pin (22) in the release position, wherein the locking pin (22) can only be displaced into the release position when all the tumbler disks (16) are in their unlatch position in which the peripheral cut-out (20) of the respective tumbler disk (16) is aligned radially to the locking pin (22); and a plurality of intermediate disks (136) arranged along the cylinder axis in the cylinder core, wherein a respective intermediate disk (136) is arranged between two mutually adjacent tumbler disks (16), wherein the intermediate disks (136) have a predefined rotational clearance (S) relative to the cylinder core (14), wherein each intermediate disk (136) has a peripheral cutaway (138) adapted to receive the locking pin (22) in its release position independently of the angular position of the intermediate disk (136), and wherein the angular dimension of the peripheral cutaway (138) of the respective intermediate disks (136) corresponds to at least the sum of the angular dimension (T) of the peripheral cut-outs (20) of the tumbler disks (16) and the rotational clearance (S) of the respective intermediate disk (136).

* * * * *